US011147376B1

(12) United States Patent
Yuki et al.

(10) Patent No.: US 11,147,376 B1
(45) Date of Patent: Oct. 19, 2021

(54) CABINET KNOBS WITH LOCK-AND-DOCK FEATURE

(71) Applicant: Terrel L. Yuki, Yorba Linda, CA (US)

(72) Inventors: Terrel L. Yuki, Yorba Linda, CA (US); James E. Grimes, Yorba Linda, CA (US)

( * ) Notice: Subject to any disclaimer, the term of this patent is extended or adjusted under 35 U.S.C. 154(b) by 0 days.

(21) Appl. No.: 17/346,489

(22) Filed: Jun. 14, 2021

Related U.S. Application Data

(62) Division of application No. 16/948,912, filed on Oct. 6, 2020, now Pat. No. 11,044,992.

(51) Int. Cl.

| | |
|---|---|
| ***A47B 95/02*** | (2006.01) |
| ***E05B 1/04*** | (2006.01) |
| ***E05B 1/00*** | (2006.01) |
| ***A47B 95/00*** | (2006.01) |

(52) U.S. Cl.
CPC ..... *A47B 95/02* (2013.01); *A47B 95/00* (2013.01); *E05B 1/0015* (2013.01); *E05B 1/04* (2013.01); *A47B 2095/024* (2013.01); *A47B 2095/028* (2013.01)

(58) Field of Classification Search
CPC ..... A47B 2095/028; A47B 2095/024; A47B 95/00; A47B 95/02; E05B 1/04; E05B 1/0015; E05B 1/0007; Y10T 16/506; Y10T 16/46; Y10T 16/4636; Y10T 292/85; Y10T 292/82; Y10T 292/854; Y10T 292/858; Y10T 292/865; Y10T 292/869; Y10T 292/873; Y10T 292/876
See application file for complete search history.

(56) References Cited

U.S. PATENT DOCUMENTS

| | | | | | |
|---|---|---|---|---|---|
| 192,759 | A * | 7/1877 | Haines | E05B 1/0007 | 292/347 |
| 231,903 | A * | 9/1880 | Dougherty | E05B 1/0007 | 292/347 |
| 818,565 | A * | 4/1906 | Schwarz | E05B 3/04 | 292/350 |
| 1,487,355 | A * | 3/1924 | Overmyer | E05B 1/0015 | 16/417 |
| 1,919,455 | A * | 7/1933 | Wilson | B29C 45/661 | 16/414 |

(Continued)

*Primary Examiner* — Patrick D Hawn
(74) *Attorney, Agent, or Firm* — Charles L. Thoeming

(57) ABSTRACT

Embodiments for lock-and-dock cabinet knobs for doors, cabinets, drawers, or other fixtures, provides an interchangeable face element attachment. The hardware fixture includes an internally threaded insert, a mounting element housing the insert and having internal and top peripheral mechanical attachment assemblies, and a face element having mechanically attachment assemblies rotatably corresponding to and attaching to the mounting element mechanical assemblies and a planar top. The face element planar top can receive and secure several varied and customizable, interchangeable parts. The face element is mechanically affixed to the mounting element to resist being dislodged inadvertently, while being easily removed when so intended, in particular by the easily operable lock-and-dock assembly mounting without the need to disconnect the threaded insert and mounting element housing from the drawer or cabinet door. An embodiment provides a refillable domed capsule as part of removable face element.

10 Claims, 12 Drawing Sheets

(56) References Cited

U.S. PATENT DOCUMENTS 3,017,658 A * 1/1962 Aston ..... A47B 95/02 16/414
3,024,555 A * 3/1962 Abeles ..... E05B 1/0007 40/331
3,371,373 A * 3/1968 Admas ..... E05B 1/0007 16/417
3,487,496 A * 1/1970 Warbington ..... E05B 1/0007 16/414
4,413,374 A * 11/1983 Ferdinand ..... A47B 95/02 16/441
4,972,545 A * 11/1990 Ozagir ..... E05B 1/0015 16/414
5,499,427 A * 3/1996 Bowman ..... A47B 95/02 16/417
6,108,944 A * 8/2000 Savoie ..... A43C 15/161 220/293
6,231,092 B1 * 5/2001 Shields ..... E05B 1/0015 292/347
6,463,630 B1 * 10/2002 Howie, Jr. ..... G05G 1/10 16/441
6,533,336 B2 * 3/2003 Kemp ..... E05B 3/003 16/441
6,687,957 B2 * 2/2004 Worrell ..... G05G 1/10 16/414
6,842,946 B2 * 1/2005 Hayden ..... A47B 95/02 16/414
7,111,365 B1 * 9/2006 Howie, Jr. ..... E05B 1/0007 16/414
7,118,138 B1 * 10/2006 Rowley ..... F16B 7/0406 285/332.2
7,963,003 B1 * 6/2011 Keene ..... G05G 1/10 16/441
8,360,488 B2 * 1/2013 Forrest ..... E05B 1/0015 292/348
8,510,915 B2 * 8/2013 Daniels ..... E05B 1/0007 16/417
9,970,592 B2 * 5/2018 Wu ..... E05B 1/0015
10,477,968 B2 * 11/2019 Maier ..... B33Y 80/00
2004/0078933 A1 * 4/2004 Forrest ..... E05B 1/0015 16/417
2008/0252086 A1 * 10/2008 Houis ..... E05B 3/00 292/348
2009/0079311 A1 * 3/2009 Lai ..... A47B 95/02 312/332.1
2010/0308605 A1 * 12/2010 Fiedler ..... A45C 13/1084 292/251.5
2012/0311820 A1 * 12/2012 Chang ..... E05B 17/0004 16/110.1
2017/0156497 A1 * 6/2017 Maier ..... E05B 1/0084
2018/0045364 A1 * 2/2018 Wu ..... E05B 1/0015

* cited by examiner

CABINET KNOBS WITH LOCK-AND-DOCK FEATURE

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

NOTICE REGARDING COPYRIGHTED MATERIAL

A portion of disclosing this patent document contains material subject to copyright protection and/or copyright registration. The copyright owner has no objection to the facsimile reproduction by anyone of the patent document or the patent disclosure as it appears in the file or records maintained by the United States Patent and Trademark Office, but the copyright owner otherwise reserves all copyright rights.

TECHNICAL FIELD

This invention relates to decorative and useful hardware fixtures for cabinets, drawers, other fixtures and furniture and more particularly to a manual pull having an interchangeable part that can be decorative, informational, or useful. The pull can be altered by interchanging the part for one with a different three-dimensional geometry, alternative decoration or finish, indicia, or the like. The interchangeable part is affixed to resist being dislodged inadvertently, while being easily removed when so intended, in particular by an easily operable lock and dock assembly mounting without the need to disconnect the entire unit from the drawer or cabinet door.

BACKGROUND OF THE INVENTION

Cabinets, drawers, other fixtures, furniture pieces are often provided with hardware fixtures such as knobs and pulls. Pulls are manually useful for opening doors, cabinets, drawers and advantageously also may be decorative or informational in appearance. Typical knobs or pulls may be wood or may comprise brass, zinc or similar metal hardware affixed relatively permanently to a cabinet door, drawer front or other item. In specifying a furniture design, the designer or refinisher may choose among a wide variety of hardware elements including drawer and cabinet pulls. The selection of such hardware can have a great effect on the style and appearance of the furniture or cabinetry, being formal or informal, historical or modern, generic or personalized, decorative or utilitarian. To achieve the desired theme, particular hardware elements used for comparable functions might vary widely in size, shape, color or finish, formality versus folksiness, ornateness versus simplicity and several other ranges of choice.

A supplier of such hardware pragmatically must offer and stock a wide range of such hardware inventory. Variation is mostly a decorative matter because besides scale, there may be little necessary variation is structure to meet minimum functional requirements. The pull only needs to present a protrusion securely affixed to the door or drawer and provide a size, shape and position making it reasonably comfortable to grasp and pull. Most of the variation among alternatives is not dictated by function. Thus, knobs and pulls might be made distinguishable to identify the contents of different drawers to identify the owner by initials or color scheme. These hardware elements might be used for celebratory occasions with themes for seasons, holidays, birthdays, anniversaries, and other special occasions.

Once installed, generally with metal fasteners hardware fixtures have an element of permanence. Conventional fixtures remain where installed unless the owner has a strong desire or opportunity to change them. A change requires considerable effort, inconvenience and/or damage to the furniture and may require a hand tool or power tool. The old and new hardware may not match in shape or fastener placement, making it necessary to refinish the site, substitute a larger hardware device than before or leave unsightly non-functional holes exposed. When hardware is changed, there is little or no part of the old hardware that can be saved and reused.

It would be useful to provide a knob or pull for furniture or for a fixture such as a cabinet, drawer, or door with an easily changeable appearance without having to disconnect the entire unit from the drawer/door.

It would be further desirable to provide, as part of a knob, an aesthetically pleasing or functional decoration or indicia which is durable but easily replaceable or interchangeable.

It would also be advantageous to customize replacement hardware fixtures associated with countertops, cabinets, drawers, and doors at minimal cost.

DISCLOSURE OF INVENTION

The disclosed cabinet knobs with lock-and-dock feature include an internally threaded insert, a mounting element housing the insert and having internal and top peripheral mechanical attachment assemblies, and a face element having mechanically attachment assemblies rotatably corresponding to and attaching to the mounting element mechanical assemblies and a planar top. The face element planar top can receive and secure several varied and customizable, interchangeable parts. Each interchangeable part is affixed to resist being dislodged inadvertently, while being easily removed when so intended, in particular by the easily operable lock and dock assembly mounting without the need to disconnect the threaded insert and mounting element housing from the drawer or cabinet door.

BRIEF DESCRIPTION OF DRAWINGS

These and other features, aspects, and advantages of the present invention will become better understood regarding the following description, and drawings as further described.

BEST MODE FOR CARRYING OUT THE INVENTION

Figure 4:
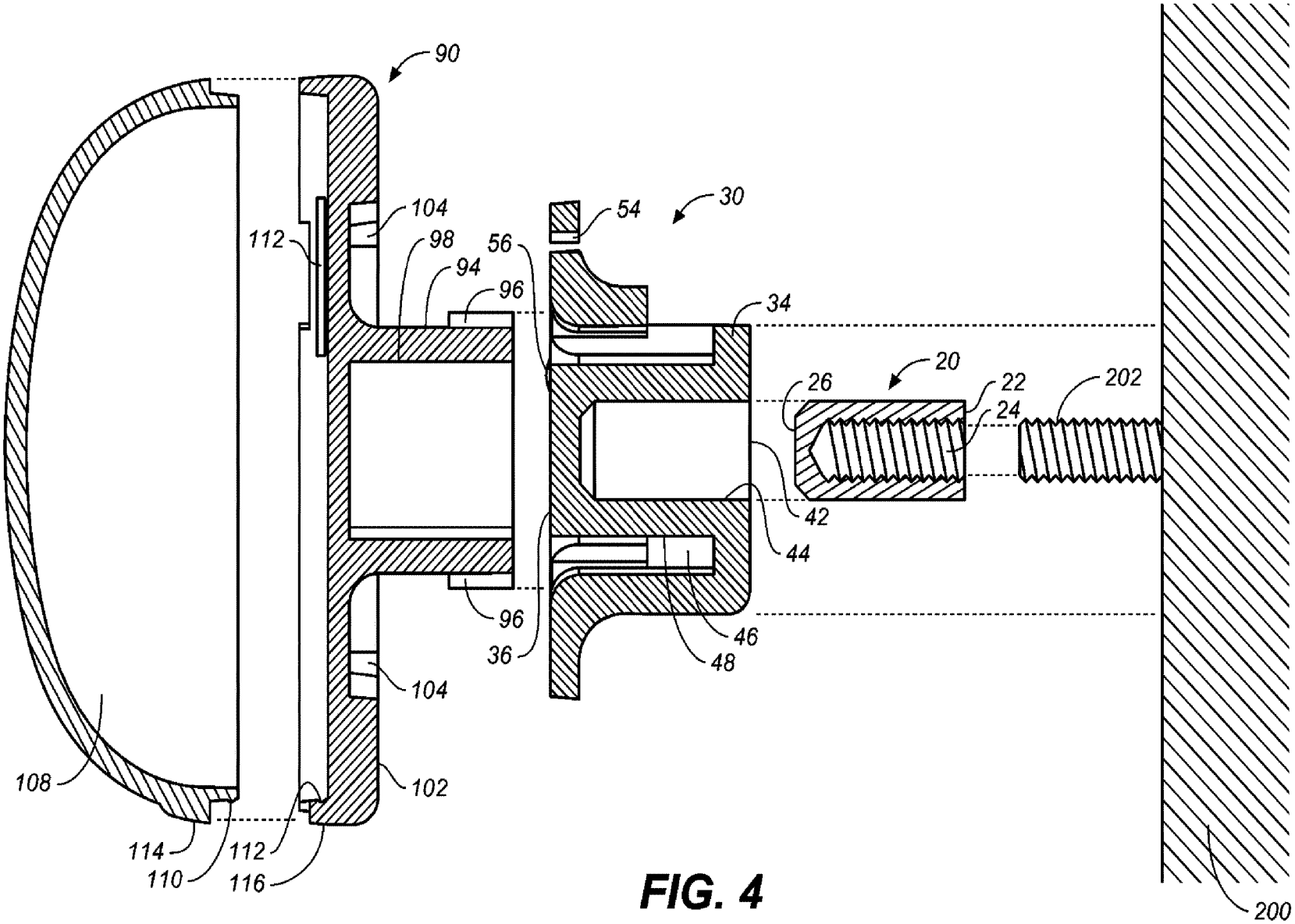
FIG. 4 is an exploded cross-sectional view of the embodiment of cabinet knob with lock-and-dock feature 12 of FIGS. 1A and 1B.
Figure 5A:
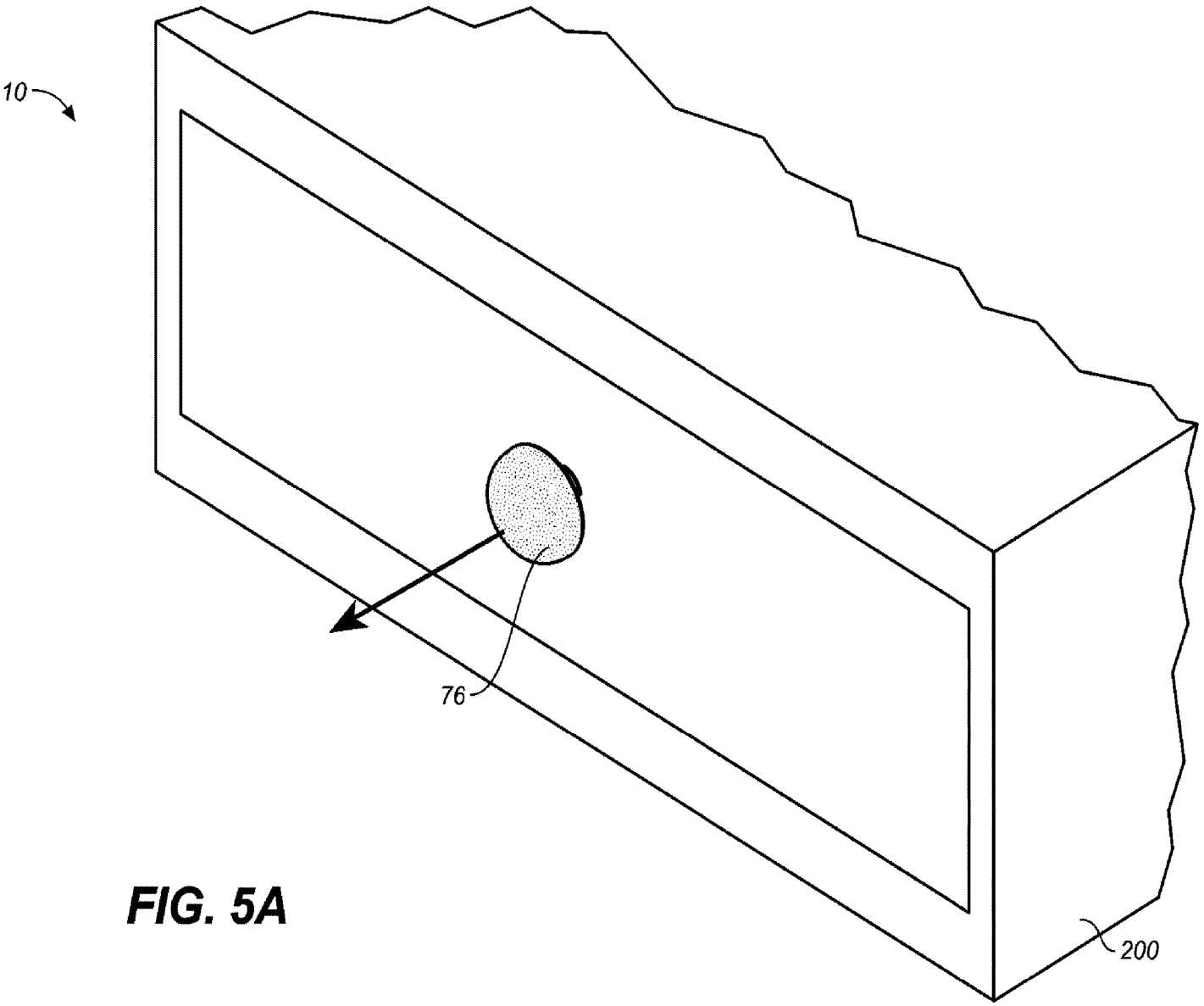
FIG. 5A is a perspective view depicting an embodiment of the cabinet knob with lock-and-dock feature 10 used in a drawer-pull environment.
Figure 5B:
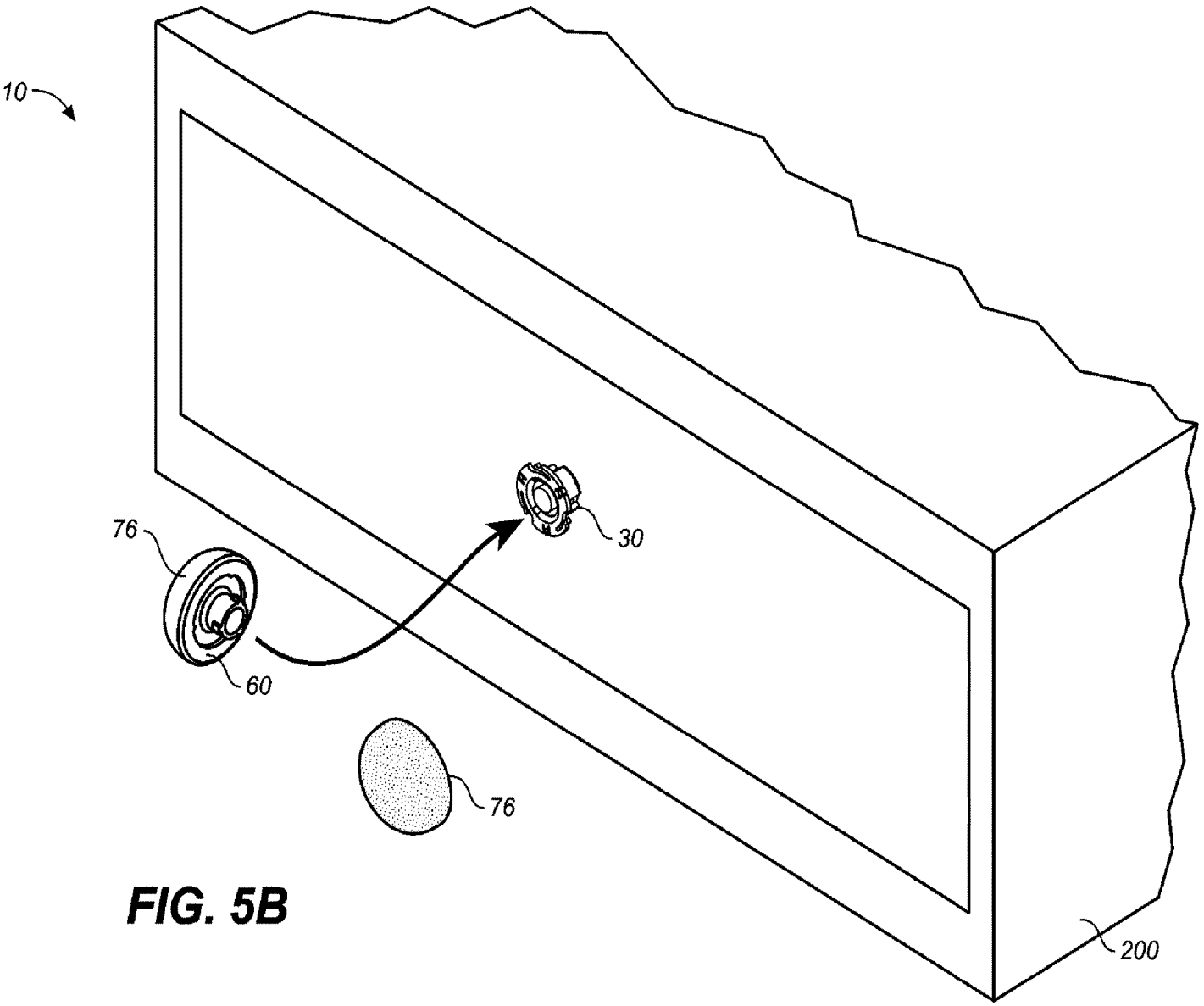
FIG. 5B is a perspective view of FIG. 5A depicting the interchange of a knob element 76 on the face element 60 releasably detached from mounting element 30.
Figure 6B:
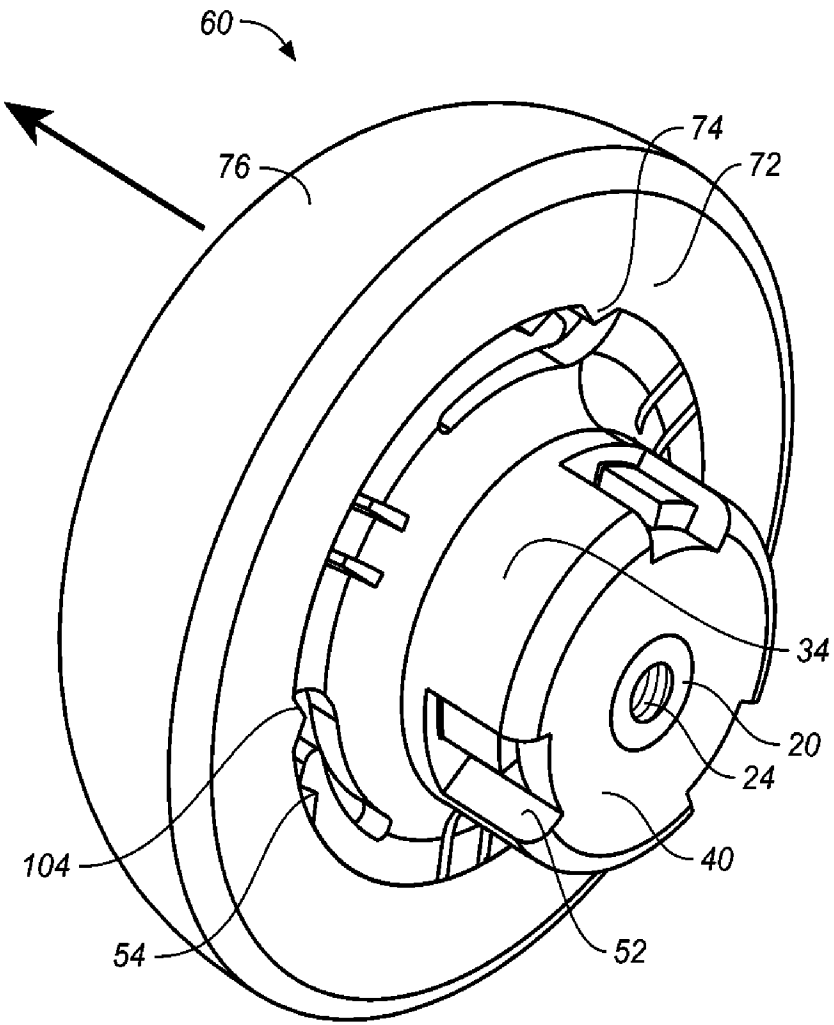
FIG. 6B is rear perspective view of FIGS. 5A and 5B depicting the face element 60 locked onto the mounting element 30 to provide stable support for pulling on the capsule to open a drawer.
Figure 6A:
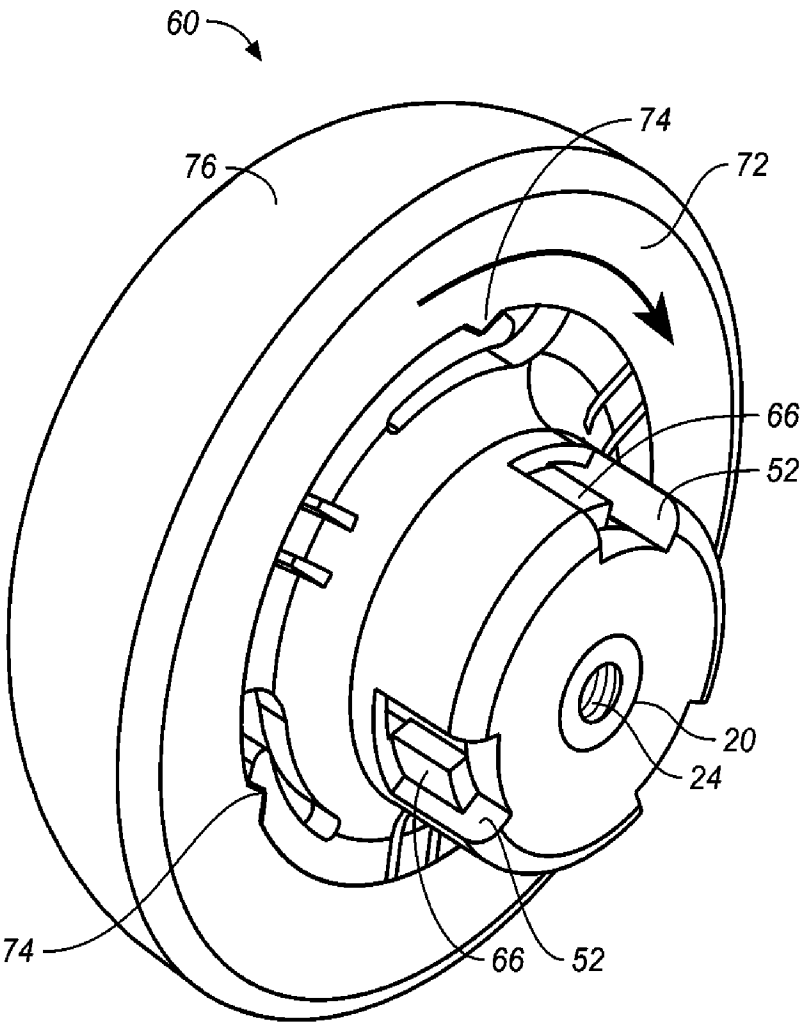
FIG. 6A is a rear perspective view of FIGS. 5A and 5B depicting the face element 60 locking into the mounting element 30.
Figure 6C:
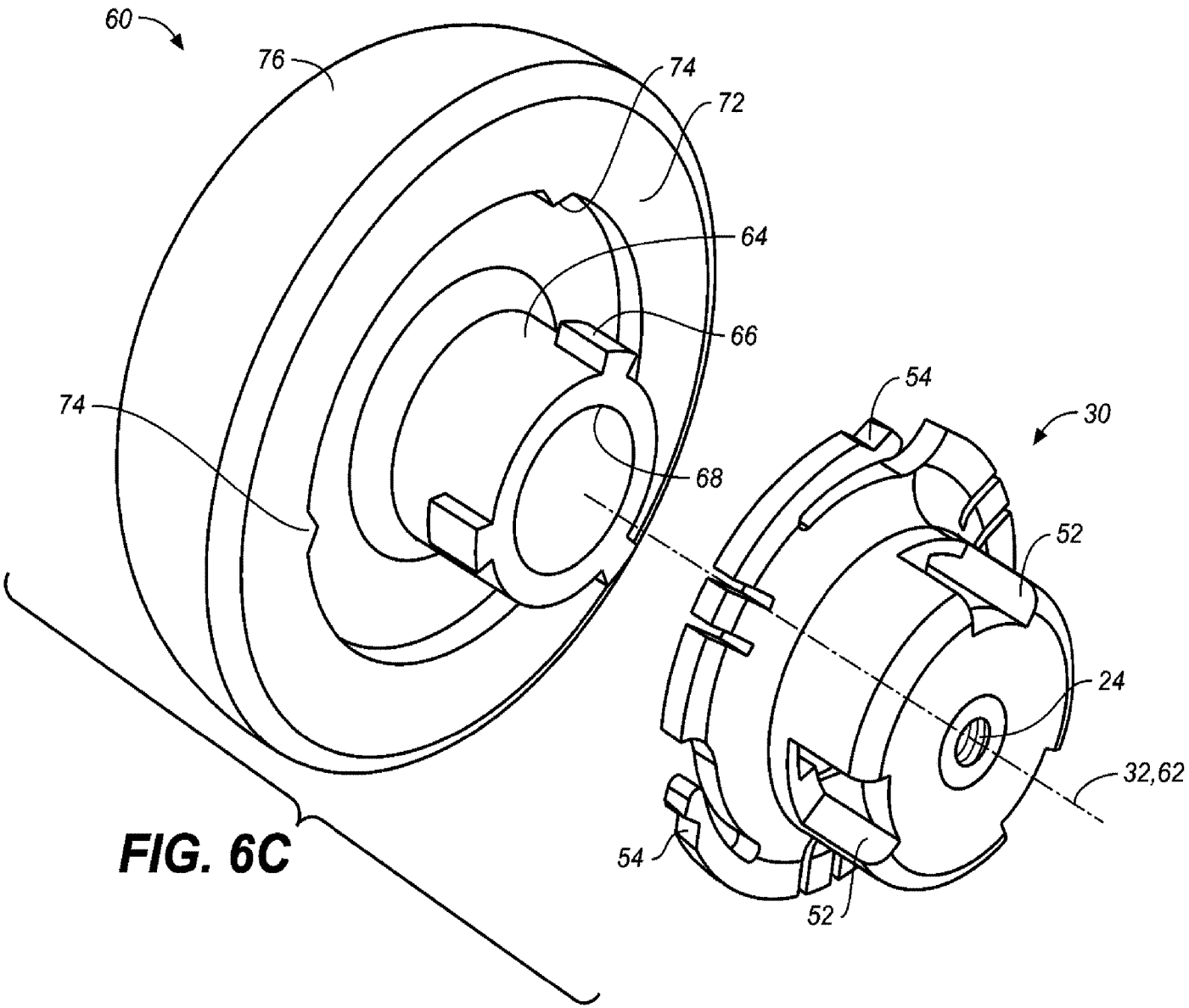
FIG. 6C is an exploded rear perspective view of FIG. 5A depicting face element 60 and mounting element 30.
Figure 7:
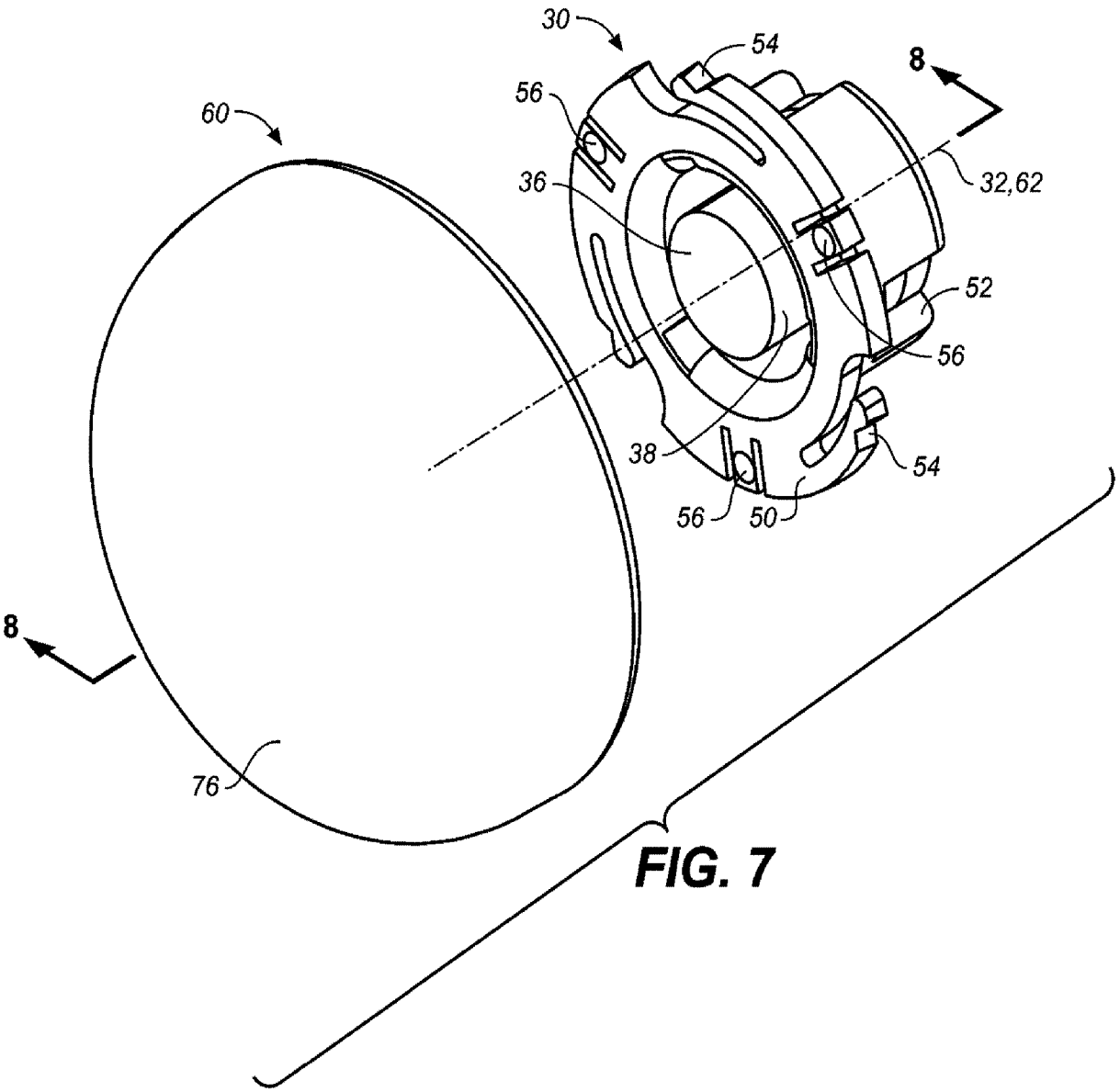
FIG. 7 is an exploded front perspective view of FIGS. 5A and 5B depicting face element 60, the face element knob 76, and the mounting element 30.
Figure 8:
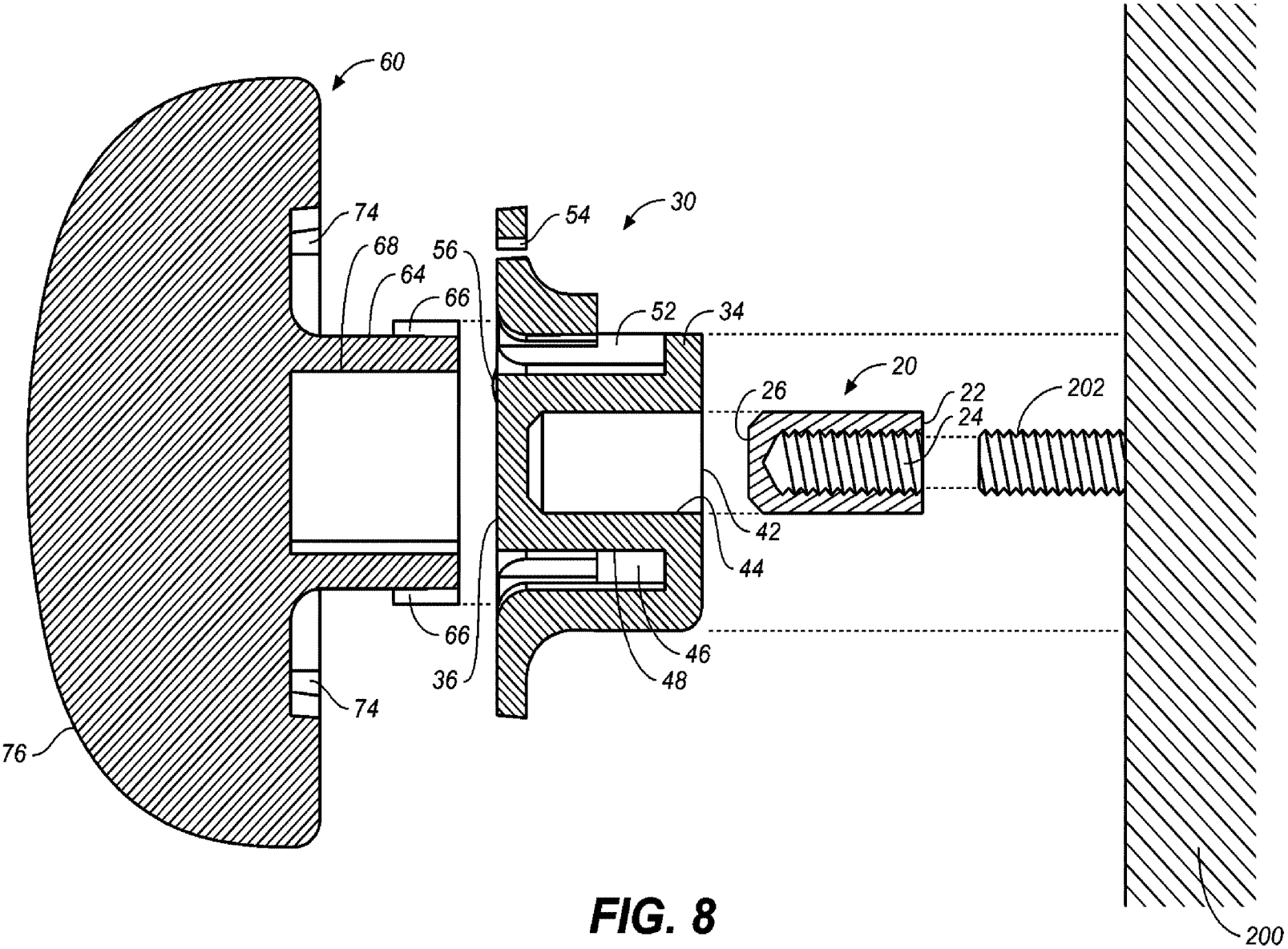
FIG. 8 is an exploded cross-sectional view of the embodiment of cabinet knob with lock-and-dock feature 10 of FIGS. 5A and 5B.

Lock-and-dock cabinet knob embodiments 10 or 12 include an insert 20 providing an internal threaded portion 24 in an insert bottom end 22 and an insert top end 26. The insert internal threaded portion 24 is sized to be attached to a threaded member 202 extending orthogonally from a planar front surface of a cabinet drawer 200 or door, FIGS. 4 and 8. The insert top end 26 is sized to be received into and fused to a mounting element first internal surface 44 providing a substantially planar surface of the insert bottom end surface and the mounting element base bottom surface. An embodiment of the insert is brass.

Lock-and-dock cabinet knob embodiments 10 or 12 include a mounting element 30 having a mounting element longitudinal axis 32, a mounting element base 34 providing a mounting element base top 36. The mounting element base top 36 includes a planar top surface 50, an external surface 38 and a base bottom 40 including an internal opening 42 and a mounting element first internal surface 44 sized to receive and be fixedly attached to the insert top end 26. The mounting element 30 includes an internal opening 46 around the base top external surface 38 providing a mounting element second internal surface 48 centered on the longitudinal axis 32, an interlocking assembly within the mounting element internal opening 46 around the mounting element base external surface 38, and an interlocking assembly on a periphery around the mounting element planar top surface 50, FIGS. 2A-4, and 6A-8.

Lock-and-dock cabinet knob embodiments 10 include a face element 60 comprising a face element longitudinal axis 62 and a face element base 64 centered on the face element longitudinal axis 62 providing an face element base internal surface 68 sized to receive the mounting element base top external surface 38, FIGS. 6A-8. The face element base 64 provides an external surface sized to be received into the mounting element internal opening 46 around the mounting element base top external surface 38, an interlocking assembly corresponding to the mounting element interlocking assembly within the mounting assembly second internal surface 48, and a face top 72 comprising an interlocking assembly on a periphery of the face element top surface corresponding to the mounting element planar top periphery interlocking assembly.

Lock-and-dock cabinet knob embodiments 10 or 12 include an insert 20, a mounting element base 34, a mounting element first internal surface 44, a mounting element second internal surface 48, a face element base internal surface 68 or 98, and the face element base external surface 66 or 96 are cylindrical. For these embodiments of the drawer or cabinet pull assembly the mounting element base bottom internal opening 42, the mounting element planar top surface internal opening 46, and the face element top 70 or 100 are circular, FIGS. 2A-4, and 5A-8.

Lock-and-dock cabinet knob embodiments 10 provide mounting element 30 and face element 60 interlocking assemblies that include three equal sized openings 52 on the mounting element second internal surface 48, each equal sized opening spaced equidistant from the other openings about the mounting element longitudinal axis 32, and three equal sized protrusions 66 on a face element base external surface, each protrusion 66 sized to be received into and held by one of the equal sized openings 52 on the mounting element second internal surface 48 and each protrusion 66 spaced equidistant from the other protrusions 66 about the face element central longitudinal axis 62, and three equal sized domes 56, each dome 56 on the mounted element top periphery between each slotted opening 54. The three equal sized slotted openings on the mounting element planar top periphery corresponding in positional alignment about the mounting element longitudinal central axis with the three equal sized openings 52 on the mounting element second internal surface 48, and the three equal sized detents 74 disposed on the periphery of the face element top side bottom surface 72 at a position corresponding to a protrusion 66 on the external base side of the face element about the face element central longitudinal axis 62. When the mounting element longitudinal axis 32 is aligned with the face element longitudinal axis 62, clockwise rotation of the face element planar surface in contact with the mounting element top planar surface domes allows each face element detent 74 to correspond with a mounting element slotted opening 54 and provides mating of each face element protrusion 66 with a corresponding mounting element interior surface opening 52 on the mounting element second internal surface 48 releasably locking the face element to the mounting element and allowing the assembly to be pulled to open a drawer or cabinet door, FIGS. 6A-6C. Mounting element planar top surface domes 56 stabilize the face element 60 to the mounting element 30. The face element 60 can be released and removed from the mounting element 30 by counter-clockwise rotation of the face element 60 in planar contact with the mounting element 30 and when the locking assemblies disengage, pulling the face element 60 from the mounting element 30, FIGS. 5A-6C.

Lock-and-dock cabinet knob embodiments 10 provide a face element with a geometric shape affixed to a circular face element base that includes the attachment assembly sized to attach to and be secured by the top surface of the face element planer surface as disclosed. For some drawer or cabinet pull assembly embodiments 10 the geometric shape is a dome, and the mounting element 30 and the face element 60 are polycarbonate. As a user wishes to change the geometry, aesthetic, or faux material look of a drawer or cabinet pull, the face element can 30 be disengaged from the mounting element 60, and a new face element 30 with the desired changed face element knob 76 feature relocked-and-redocked with the existing mounting element 30 for use as the drawer or cabinet door pull, FIGS. 5A-8. While the disclosed embodiment provides a face element know 76 that is domed, it is understood that Polycarbonate face element knobs 76 can be shaded, colored, and shaped into a multitude of geometrically distinct forms providing different faux metal patinas or faux grained wooden pulls.

Lock-and-dock cabinet knob embodiments 12 provide mounting element 30 and face element 90 interlocking assemblies that include three equal sized openings 52 on the mounting element second internal surface 48, each equal sized opening spaced equidistant from the other openings about the mounting element longitudinal axis 32, and three equal sized protrusions 96 on a face element base external surface, each protrusion 96 sized to be received into and held by one of the equal sized openings 52 on the mounting element second internal surface 48 and each protrusion 96 spaced equidistant from the other protrusions 96 about the face element central longitudinal axis 92, and three equal sized domes 56, each dome 56 on the mounted element top periphery between each slotted opening 54. The three equal sized slotted openings on the mounting element planar top periphery corresponding in positional alignment about the mounting element longitudinal central axis with the three equal sized openings 52 on the mounting element second internal surface 48, and the three equal sized detents 104 disposed on the periphery of the face element top side bottom surface 102 at a position corresponding to a protrusion 96 on the external base side of the face element about the face element central longitudinal axis 62. When the mounting element longitudinal axis 32 is aligned with the face element longitudinal axis 62, clockwise rotation of the face element planar surface in contact with the mounting element top planar surface domes allows each face element detent 74 to correspond with a mounting element slotted opening 54 and provides mating of each face element protrusion 96 with a corresponding mounting element interior surface opening 52 on the mounting element second internal surface 48 releasably locking the face element to the mounting element and allowing the assembly to be pulled to open a drawer or cabinet door, FIGS. 2A-3. Mounting element planar top surface domes 56 stabilize the face element 90 to the mounting element 30. The face element 90 can be released and removed from the mounting element 30 by counterclockwise rotation of the face element 90 in planar contact with the mounting element 30 and when the locking assemblies disengage, pulling the face element 90 from the mounting element 30, FIGS. 2A-3.

Figure 1A:
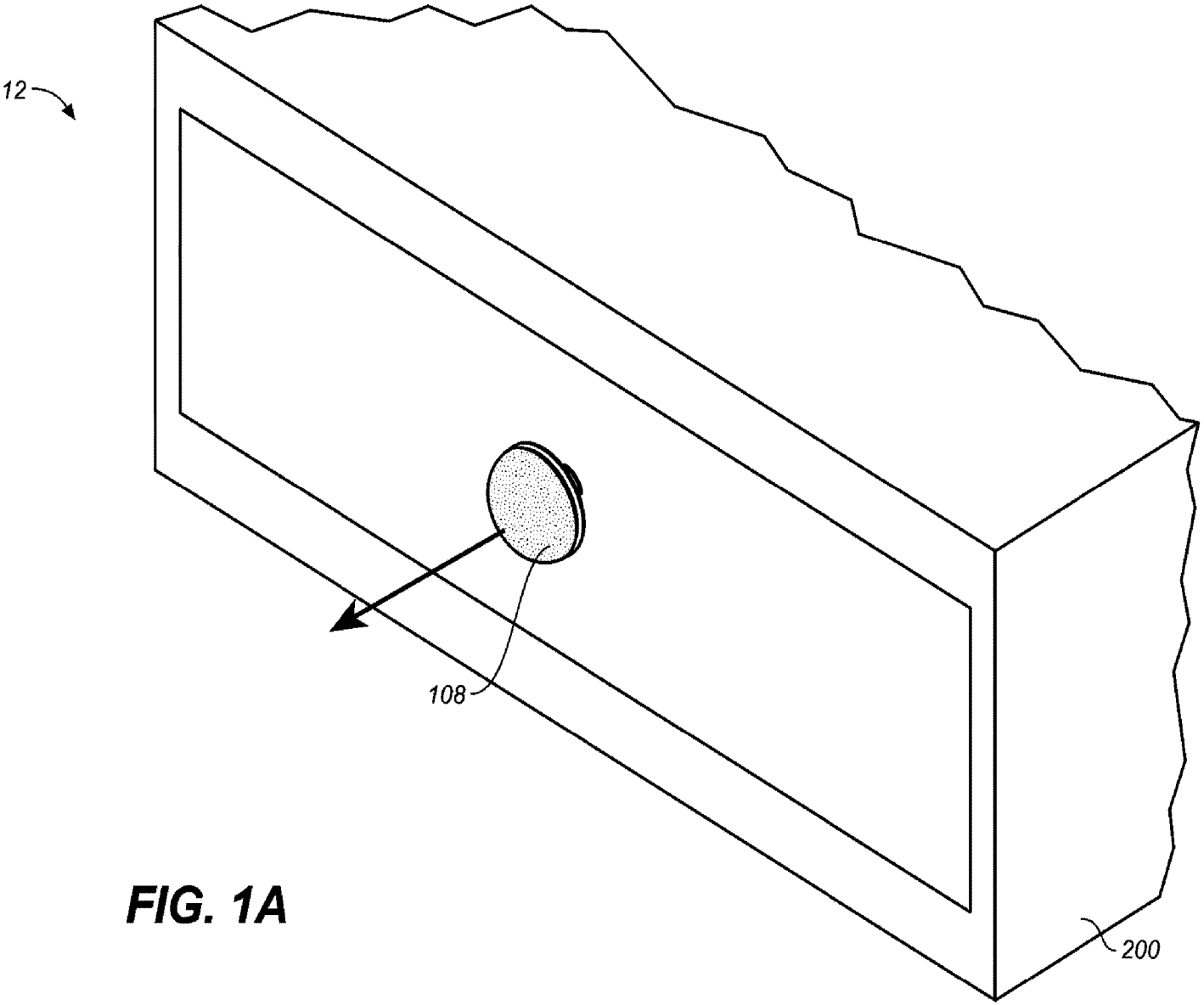
FIG. 1A is a perspective view depicting an embodiment of the cabinet knob with lock-and-dock feature 12 used in a drawer-pull environment.
Figure 1B:
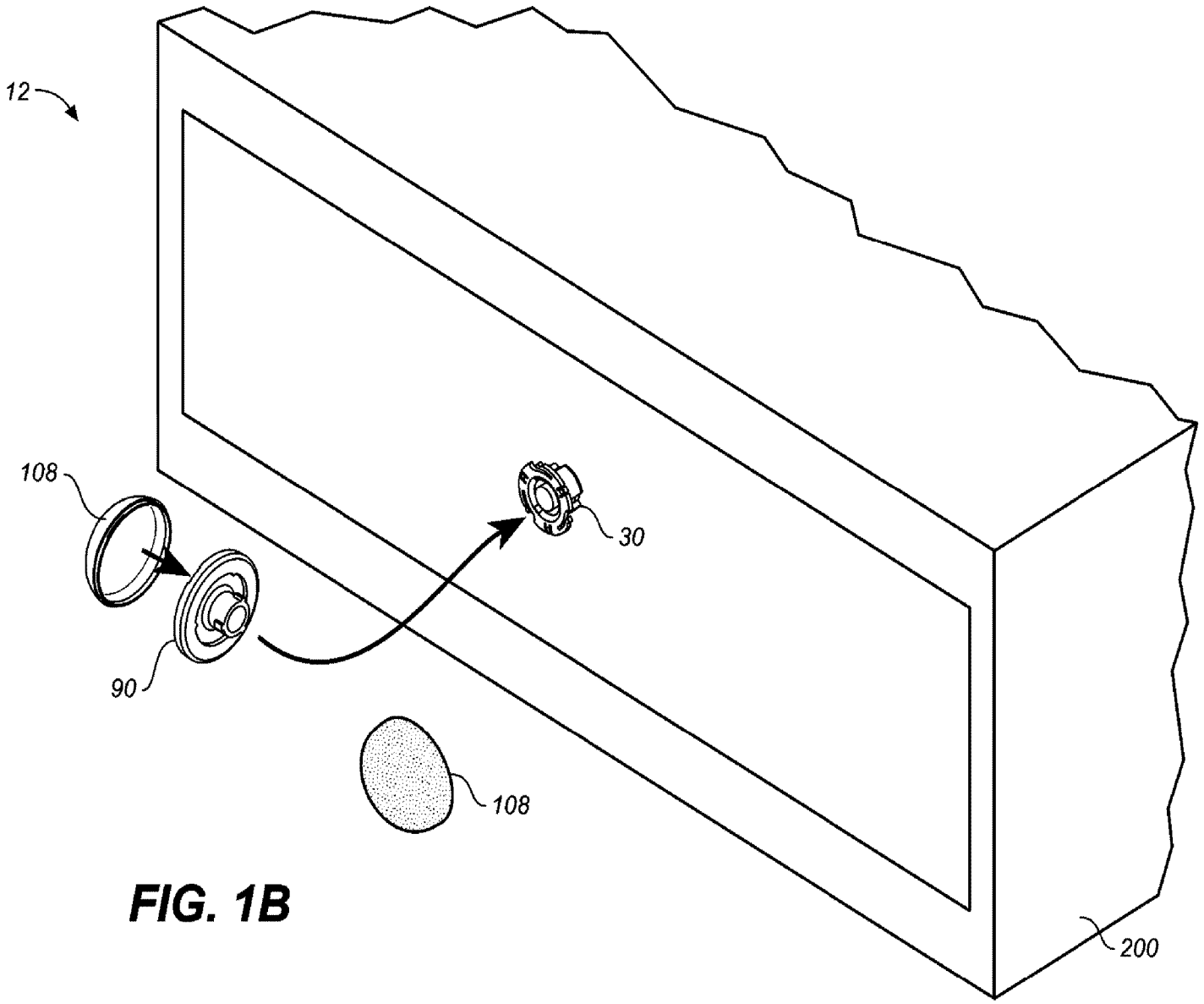
FIG. 1B is a perspective view of FIG. 1A depicting the interchange of a capsule element 108 on the face element 90 releasably detached from mounting element 30.
Figure 2B:
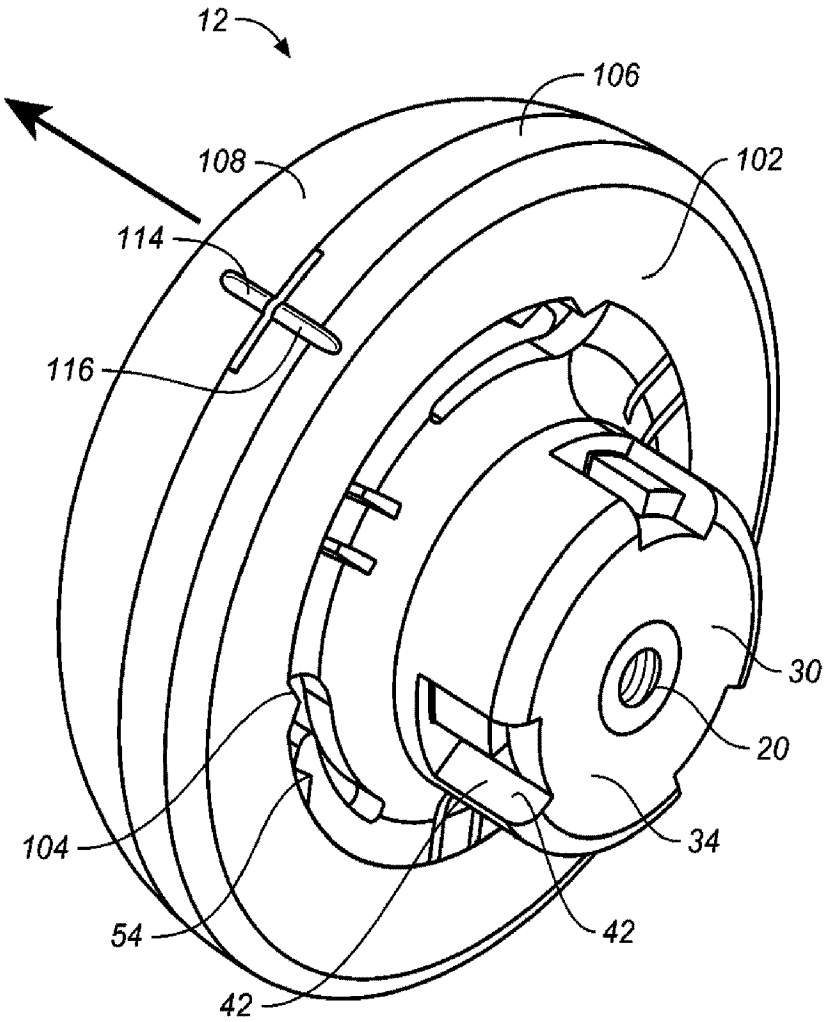
FIG. 2B is rear perspective view of FIGS. 1A and 1B depicting the face element 90 locked onto the mounting element 30 to provide stable support for pulling on the capsule to open a drawer.
Figure 2A:
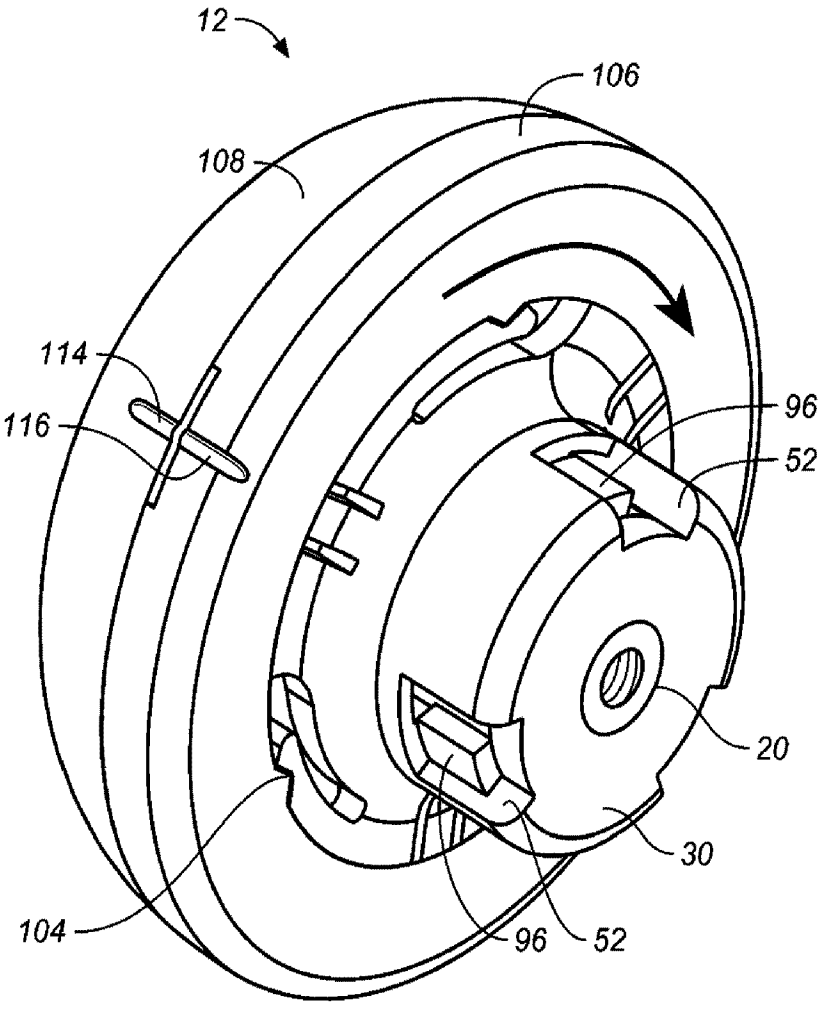
FIG. 2A is a rear perspective view of FIGS. 1A and 1B depicting the face element 90 locking into the mounting element 30.
Figure 2C:
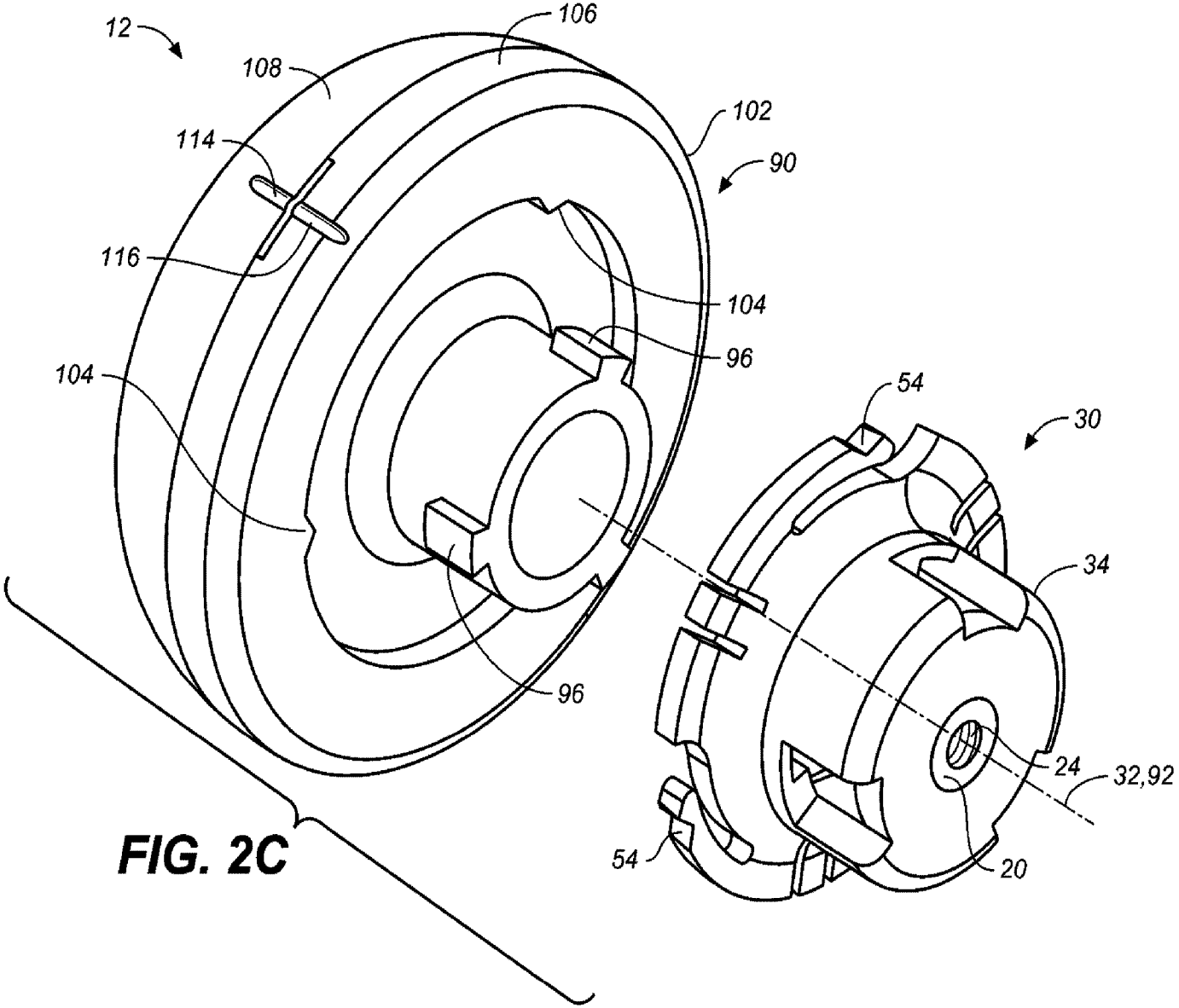
FIG. 2C is an exploded rear perspective view of FIG. 2A depicting face element 90 and mounting element 30.
Figure 3:
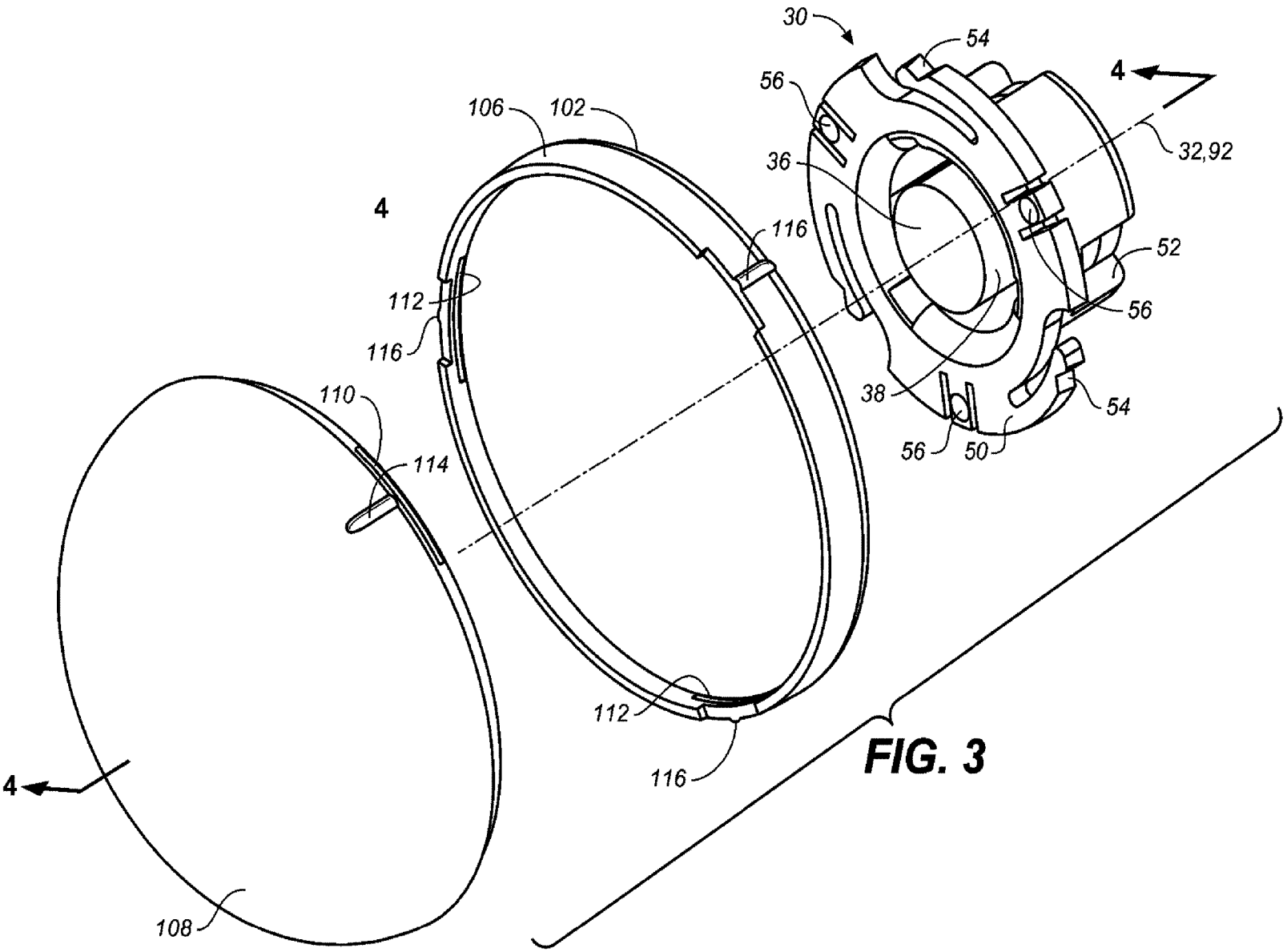
FIG. 3 is an exploded front perspective view of FIGS. 1A and 1B depicting mounting element 30, the face element bottom side 102, the face element top capsule base 106, and the capsule 108.

Lock-and-dock cabinet knob embodiments 12 provide a face element with an optically transparent domed capsule 108 filled with materials according to a user's requirements and affixed to a circular face element base 94 by the face element top capsule base 106 and the face element top bottom side 102, FIG. 3. For some drawer or cabinet pull assembly embodiments 12 the geometric shape is an optically transparent domed capsule 108, and the mounting element 30 and the face element 90 are polycarbonate. Once the face element 90 has been detached and removed from the mounting element as disclosed, the optically transparent domed capsule 108 can be removed from the face element top capsule base 106 and the filled materials within the optically transparent domed capsule 108 changed according to user requirements or preference. Once the optically transparent domed capsule 108 filled materials have been changed, the face element 90 can be fitted onto the optically transparent domed capsule 108 and the face element top capsule base 106 locked thereto without losing the new filled material contents of the optically transparent domed capsule 108. Alignment of the optically transparent domed capsule 108 and the face element top capsule base 106 is facilitated by three capsule alignment indicators 114 and three face element top capsule base alignment indicators 116 spaced equally about the face element longitudinal axis 92, FIGS. 2A-4. A capsule detent 110 is sized to be received by a face element top capsule base indent 112, FIG. 4, to secure the optically transparent domed capsule 108 to the face element top capsule base 106. Then the face element 90 can be relocked-and-docked to the existing mounting element 30 for use as the drawer or cabinet door pull, FIGS. 1A-4, with new filled material in the optically transparent domed capsule 108.

It is claimed:

1. A drawer or cabinet pull assembly comprising in combination:

A) an insert comprising a top end and an internal threaded portion in a bottom end;

B) a mounting element comprising a longitudinal axis, a mounting element base comprising a base top comprising an external surface and a base bottom comprising an internal opening and mounting element first internal surface sized to receive and be fixedly attached to the insert top end, a planar top affixed to the base top external surface comprising a second internal opening around the base top external surface, a mounting element second internal surface centered on the longitudinal axis, an interlocking assembly within the mounting element second internal opening and on the mounting element base external surface, and an interlocking assembly on a periphery of the mounting element planar top; and C) a face element comprising a longitudinal axis, a face element base centered on the face element longitudinal axis comprising an internal surface sized to receive the mounting element base top external surface and an external surface sized to be received into the mounting element second internal opening around the mounting element base top external surface, an interlocking assembly corresponding to the mounting element interlocking assembly within the mounting assembly second internal surface, and a top surface comprising an interlocking assembly on an internal surface of the face element top surface corresponding to the mounting element planar top periphery interlocking assembly.

2. The assembly of claim 1, wherein the insert, the mounting element base internal surface, the mounting element base external surface, the first mounting element internal surface, the second mounting element internal surface, the face element base internal surface, and the face element base external surface are cylindrical, and the mounting element internal opening, the mounting element planar top, and the face element top surface are circular.

3. The assembly of claim 2, wherein the mounting element interlocking assemblies and the face element interlocking assemblies comprise:

A) three equal sized slotted openings on an interior surface of the mounting element planar top opening, each equal sized slotted opening spaced equidistant from the other slotted openings about the mounting element longitudinal axis, and three equal sized protrusions on an external base side of the face element, each protrusion sized to be received into and held by one of the equal sized slotted openings on the interior surface of the planar top opening and each protrusion spaced equidistant from the other protrusions about the face element central longitudinal axis, and three equal sized domes, each dome on a mounting element planar top periphery between each slotted opening; and B) three equal sized detents on the face element planar top internal surface in equal spacing about the face element longitudinal axis and corresponding in positional alignment with the three equal sized slotted openings on the interior surface of the mounting element planar top opening when the face element and mounting element longitudinal axes are aligned, and three equal sized slotted openings disposed on the mounting element planar top surface periphery at equal positions about the mounting element central longitudinal axis;

whereby, when the longitudinal axes of the mounting element and the face element are aligned, rotation of the mounting element top planar surface in contact with the face element planar surface allows each face detent to be received into a corresponding mounting element slotted opening and provides mating of each face element protrusion with a corresponding mounting element interior surface opening releasably locking the face element to the mounting element.

4. The assembly of claim 3, further comprising an optically transparent domed capsule sized to be releasably attached to the face element top capsule base, three alignment indicators equally spaced around the face element longitudinal axis and placed on a perimeter of the optically transparent domed capsule and on a perimeter of the face element top capsule base, and a detent on the perimeter of the optically transparent domed capsule sized to received and held by an indent on the perimeter of the face element top capsule base.

5. The assembly of claim 4 wherein the insert is brass, the domed capsule is optically transparent polycarbonate, and all other elements are polycarbonate.

6. A drawer or cabinet pull assembly comprising in combination:

A) a cylindrical brass insert comprising an internal threaded portion in a bottom end and a top end;

B) a polycarbonate mounting element comprising a longitudinal axis, a cylindrical mounting element base comprising a circular base top comprising an external surface and a base bottom comprising a circular internal opening and cylindrical mounting element first internal surface sized to receive and be fused to the cylindrical insert top end, a circular planar top surface affixed to the base comprising a second cylindrical internal opening around the base top external surface, a mounting element second cylindrical internal surface centered on the longitudinal axis, an interlocking assembly within the mounting element second internal opening and on the mounting element base external surface, and an interlocking assembly on a periphery of the mounting element circular planar top surface; and C) a polycarbonate face element comprising a longitudinal axis, a cylindrical face element base centered on the face element longitudinal axis comprising an internal cylindrical surface sized to receive the mounting element base top external surface and a cylindrical external surface sized to be received into the mounting element second internal opening around the mounting element base top external cylindrical surface, an interlocking assembly corresponding to the mounting element interlocking assembly within the mounting element second cylindrical internal opening, and a circular top sized to correspond to the mounting element circular planar top surface and comprising an interlocking assembly on a periphery of the face element top surface corresponding to the mounting element circular planar top surface periphery interlocking assembly.

7. The assembly of claim 6, wherein the mounting element interlocking assemblies and the face element interlocking assemblies comprise:

A) three equal sized slotted openings on an interior surface of the mounting element planar top opening, each equal sized slotted opening spaced equidistant from the other slotted openings about the mounting element longitudinal axis, and three equal sized protrusions on an external base side of the face element, each protrusion sized to be received into and held by one of the equal sized slotted openings on the interior surface of the planar top opening and each protrusion spaced equidistant from the other protrusions about the face element central longitudinal axis, and three equal sized domes, each dome on the mounting element circular planar top surface periphery between each slotted opening; and B) three equal sized detents on the face element planar top internal surface in equal spacing about the face element longitudinal axis and corresponding in positional alignment with the three equal sized slotted openings on the interior surface of the mounting element planar top opening when the face element and mounting element longitudinal axes are aligned, and three equal sized slotted openings disposed on the mounting element planar top surface periphery at equal positions about the mounting element central longitudinal axis;

whereby, when the longitudinal axes of the mounting element and the face element are aligned, rotation of the mounting element top planar surface in contact with the face element top planar surface allows each face element detent to engage a corresponding mounting element slotted opening and provides mating of each face element protrusion with a corresponding mounting element interior surface opening releasably locking the face element to the mounting element.

8. The assembly of claim 7, further comprising an optically transparent polycarbonate domed capsule sized to be releasably attached to the face element planar top.

9. The assembly of claim 8, further comprising a detent on a perimeter of the optically transparent domed capsule sized to be received and held by an indent on a perimeter of the face element top capsule base.

10. The assembly of claim 9, further comprising three alignment indicators equally spaced around the face element longitudinal axis and placed on the perimeter of the optically transparent domed capsule and on the perimeter of the face element top capsule base.

* * * * *